US005240384A

United States Patent [19]

Tuzson

[11] Patent Number: 5,240,384

[45] Date of Patent: Aug. 31, 1993

[54] PULSATING EJECTOR REFRIGERATION SYSTEM

[75] Inventor: John J. Tuzson, Evanston, Ill.

[73] Assignee: Gas Research Institute, Chicago, Ill.

[21] Appl. No.: 906,235

[22] Filed: Jun. 29, 1992

Related U.S. Application Data

[63] Continuation-in-part of Ser. No. 606,062, Oct. 30, 1990, abandoned.

[51] Int. Cl.[5] ..... F04F 5/48

[52] U.S. Cl. ..... 417/185; 417/196; 137/828

[58] Field of Search ..... 417/176, 178, 179, 180, 417/184, 185, 196, 198; 137/829, 833, 834, 828

[56] References Cited

U.S. PATENT DOCUMENTS

| | | | |
|---|---|---|---|
| 2,852,922 | 9/1958 | Neumann et al. . | |
| 3,144,037 | 8/1964 | Cargill et al. | 137/828 |
| 3,199,310 | 8/1965 | Schlichtig . | |
| 3,427,817 | 2/1969 | Rietdijk . | |
| 3,496,735 | 2/1970 | Haisma . | |
| 3,654,944 | 4/1972 | Laakaniemi et al. | 137/829 |
| 3,680,327 | 8/1972 | Stein . | |
| 3,701,264 | 10/1972 | Newton . | |
| 3,901,277 | 8/1975 | Viets | 137/829 |
| 4,041,984 | 8/1977 | Morel | 60/740 |
| 4,192,148 | 3/1980 | Spreter von Kreudenstein . | |
| 4,202,374 | 5/1980 | Butler | 137/828 |
| 4,342,200 | 8/1982 | Lowi, Jr. . | |

OTHER PUBLICATIONS

Vermeulen, P. J. et al., "Measurements of Entrainment by Acoustically Pulsed Axisymmetric Air Jets," *Journal of Engineering for Gas Turbines and Power*. vol. 8, Jul., 1986.

Parikh, P. G. et al., "Resonant Entrainment of a Confined Pulsed Jet," *Transactions of the ASME*. vol. 104, Dec., 1982.

Shapiro, A. H., *The Dynamics and Thermodynamics of Compressible Fluid Flow*, vol. II, The Ronald Press Company, 1954.

Kentfield, J. A. C., "An Approximate Method for Predicting the Performance of Pressure Exchangers," ASME Paper 68-WA/FR-37.

Shapiro, A. H., *The Dynamics and Thermodynamics of Compressible Fluid Flow*, vol. I, pp. 87-88, The Ronald Press Company, New York, 1954.

*Primary Examiner*—Richard A. Bertsch
*Assistant Examiner*—Michael I. Kocharov
*Attorney, Agent, or Firm*—Speckman, Pauley & Fejer

[57] ABSTRACT

An ejector for use in a refrigeration system has a mixing tube or diffuser which is partitioned into multiple flow passages. Selectively directing a continuously flowing primary high velocity fluid jet stream, which stream entrains a secondary fluid, cyclically into each of the multiple flow passages creates an effective pulsing of the primary high velocity fluid jet stream with respect to each flow passage. Pulsing the primary high velocity fluid jet stream in this manner enhances the mixing and compression of the primary high velocity fluid jet stream and the secondary fluid in the diffuser.

19 Claims, 4 Drawing Sheets

PULSATING EJECTOR REFRIGERATION SYSTEM

Cross-Reference to Related Application

This is a continuation-in-part patent application of a co-pending patent application having Ser. No. 07/606,062, filed Oct. 30, 1990 now abandoned.

BACKGROUND OF THE INVENTION

1. Field of the Invention

This invention relates to an ejector for use in a refrigeration system in which the efficiency of mixing the primary high velocity fluid or jet and the secondary low velocity fluid is improved by pulsating the primary fluid flow into the diffuser.

2. Description of the Prior Art

The use of ejectors in refrigeration systems has been known for a long time. (See ASHRAE Handbook 1983 Equipment Volume, Chapter 13, "Steam-jet Refrigeration Equipment.") In an ejector, a primary high velocity fluid, such as a steam, gas or vapor jet, is used to entrain and compress, while mixing, a secondary low velocity fluid. This compression process is used in place of mechanical compression to drive a refrigeration system.

Although extremely simple and inexpensive, ejectors are only infrequently used in refrigeration systems due to their low power conversion efficiency. In an ejector, mixing of the primary high velocity fluid jet stream and the secondary fluid stream occurs in the mixing section of the diffuser by shear forces between the two fluid streams. The low power conversion efficiency is due to the dissipation of energy resulting from the friction forces between the primary high velocity fluid stream and the secondary low velocity fluid stream.

To overcome the inherent limitations of the ejector, it is known that the compression process must be an unsteady or intermittent, cyclic process. (See Vermeulen, P.J. et al, "Measurements of Entrainment by Acoustically Pulsed Axisymmetric Air Jets,"*Journal of Engineering for Gas Turbines and Power.* Vol. 8, July, 1986. Also see Parikh, P.G. et al, "Resonant Entrainment of a Confined Pulsed Jet,"*Transactions of the ASME.* Vol. 104, December, 1982.)

The use of ejectors in refrigeration systems generally is taught by U.S. Pat. No. 3,427,817. U.S. Pat. No. 2,852,922 teaches an ejector having a primary nozzle through which a primary fluid is introduced into the ejector mixing tube or diffuser and having at least one secondary nozzle. Coolant is introduced through the secondary nozzle into the ejector mixing tube where it mixes with and cools the primary fluid from the primary nozzle. U.S. Pat. No. 3,496,735 teaches an ejector in which the suction pressure for entrainment of the secondary fluid is modulated by a cone shaped control pin axially displaceable in the jet tube portion of the ejector nozzle. U.S. Pat. No. 3,680,327 teaches a steam jet refrigeration apparatus having a compound ejector with a primary jet which accelerates the primary fluid but does little compression and a secondary jet which accomplishes both the mixing of the primary fluid with the secondary fluid and compression of the resulting mixture. U.S. Pat. No. 3,199,310 teaches a thermally powered ejector-type refrigeration system which operates with multiple working fluids of different molecular weights, where the primary fluid or power fluid is of greater molecular weight relative to the secondary fluid or refrigerant fluid. Additional prior art which teaches the use of ejectors in refrigeration systems includes U.S. Pat. No. 3,701,264 which teaches multiple-phase ejectors and controls therefor, U.S. Pat. No. 4,192,148 which teaches a steam-jet apparatus using a one-component refrigerant, and U.S. Pat. No. 4,342,200 which teaches an ejector in an engine cooling system. However, none of the prior art of which I am aware teaches the use of a pulsating ejector for increasing ejector efficiency in a refrigeration system.

SUMMARY OF THE INVENTION

Accordingly, it is an object of this invention is to increase the efficiency of an ejector in a refrigeration system by oscillating the primary high velocity fluid jet stream.

Mixing and compression of a primary high velocity fluid jet stream and an entrained secondary low velocity fluid stream in conventional ejectors occur due to shear forces between the two fluid streams. The friction forces between the two streams dissipate energy resulting in a low power conversion efficiency. Accordingly, it is another object of this invention to provide an ejector in which mixing and compression of the primary high velocity fluid jet stream and the entrained secondary fluid stream are accomplished by normal pressure forces rather than shear forces.

It is generally known in the prior art that an ideal compression process in which no energy losses are encountered must be an unsteady or intermittent, cyclic process. It is yet a further object of this invention to provide an unsteady, cyclic process for mixing and compressing the primary high velocity fluid jet stream and the entrained secondary low velocity fluid stream in an ejector.

It is still a further object of this invention to create instability in the primary high velocity fluid jet stream injected into the mixing tube or diffuser of an ejector.

These and other objects are achieved by an ejector for a refrigeration system in accordance with this invention in which a primary high velocity fluid jet stream is effectively pulsated within each flow passage of a plurality of flow passages within the diffuser of an ejector, said flow passages created by inserting longitudinal partitions into the diffuser of the ejector. The ejector further comprises means for injecting said primary high velocity fluid jet stream into an inlet end of said diffuser, means for entraining a secondary fluid into the diffuser and means for selectively directing, in a cyclic manner, the primary high velocity fluid jet stream into each of the flow passages.

BRIEF DESCRIPTION OF THE DRAWINGS

These and other objects and features of the invention will be more readily understood and appreciated from the description and drawings contained herein, wherein.

DESCRIPTION OF PREFERRED EMBODIMENTS

Figure 1:
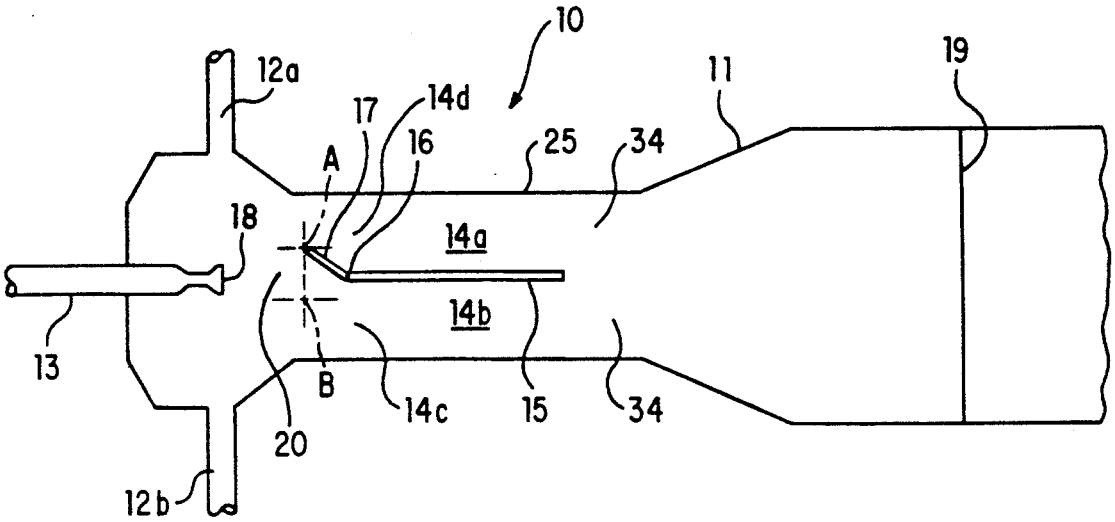
FIG. 1 is a schematic diagram showing a side view of a pulsating ejector according to one embodiment of the invention.

Referring to a preferred embodiment of the invention shown in FIG. 1, pulsating ejector 10 has mixer 25 with inlet end 20 into which, by means for injecting a primary high velocity fluid jet stream, a primary high velocity fluid jet stream is injected through discharge end 18 of primary fluid nozzle 13. As used in this disclosure and claims, high velocity is defined to be at or above the sonic velocity of the primary fluid. When the primary high velocity fluid jet stream is injected into mixer 25, secondary low velocity fluid is entrained by mean for entraining said secondary low velocity fluid through openings 12*a* and 12*b* into mixer 25 where it mixes with the primary high velocity fluid jet stream and is compressed. As used in this disclosure and claims, low velocity is defined to be below the sonic velocity of the secondary fluid. The compressed mixture is discharged through exit end 19 of diffuser 11 disposed downstream of mixer 25. Partition 15 is mounted within mixer 25 and separates the space inside mixer 25 into multiple or parallel flow passages 14*a* and 14*b* having flow passage inlet ends 14*c* and 14*d*. The primary high velocity fluid jet stream and the secondary low velocity fluid are directed into multiple flow passages 14*a* and 14*b* by said means for selectively directing, in a cyclic manner, the primary high velocity fluid jet stream into each of the flow passages, of which several embodiments are described hereinbelow.

It will be apparent that partition 15 need not abut the walls of mixer 25 to separate the space inside mixer 25 into multiple flow passages 14*a* and 14*b* as long as resulting leakage between multiple flow passages 14*a* and 14*b* is maintained at a minimum. It is, however, preferred that partition 15 actually abut the walls of mixer 25. It will also be apparent that a flow passage may receive secondary low velocity fluid from more than one secondary low pressure fluid opening 12*a* and 12*b*, and likewise it will be apparent that more than one flow passage may receive secondary low velocity fluid from a single secondary low velocity fluid opening 12*a* or 12*b*. However, it is preferred that each secondary low velocity fluid opening 12*a* or 12*b* is positioned to convey secondary low velocity fluid primarily to only one flow passage inlet end 14*c* or 14*d* of flow passage 14*a* or 14*b*.

Attached by pivotal means to partition 15 proximate inlet end 20 of mixer 25 is vane 17 which pivots around pivot point 16 in accordance with one embodiment of this invention. Vane 17 is oscillated by mechanical means between points A and B such that when vane 17 is at point A, the primary high velocity fluid jet stream from discharge end 18 of primary fluid nozzle 13 is directed into flow passage 14*b* and generally entrains secondary low velocity fluid through opening 12*b*, and when vane 17 is at point B, the primary high velocity fluid jet stream from discharge end 18 of primary fluid nozzle 13 is directed into flow passage 14*a* and generally entrains secondary low velocity fluid through opening 12*a*. As a result, a pulsating flow is created in each flow passage 14*a*, 14*b* without ever interrupting the primary high velocity fluid jet stream flow.

That only two parallel flow passages 14*a* and 14*b* are shown in FIGS. 1, 2, 3 and 4 is in no way intended to limit the number of flow passages which may be created by partitions within mixer 25. In embodiments having more than two flow parallel passages 14*a*, 14*b*, the number of secondary low velocity fluid openings 12*a*, 12*b* is preferably adjusted to equal the number of parallel flow passages. It will also be apparent that partition 15 may separate the space inside mixer 25 into flow passages 14*a*, 14*b* which are not parallel. It is, however, preferred that flow passages 14*a*, 14*b* are parallel and generally symmetric with respect to each other.

Figure 2:
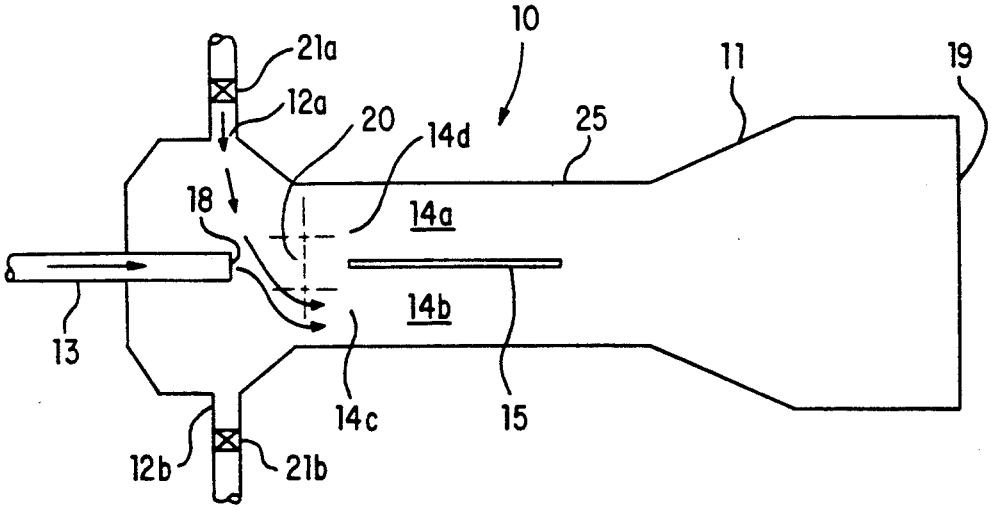
FIG. 2 is a schematic diagram showing a side view of a pulsating ejector according to another embodiment of the invention.

FIG. 2 shows another embodiment of the invention. As in the embodiment of FIG. 1, a primary high velocity fluid jet stream is injected through discharge end 18 of primary fluid nozzle 13 into inlet end 20 of mixer 25 containing partition 15. In FIG. 2, secondary fluid openings 12*a* and 12*b* are in communication with suction port valves 21*a* and 21*b*. As the primary high velocity fluid jet stream is injected through discharge end 18 of primary fluid nozzle 13, suction port valves 21*a* and 21*b* are alternately and selectively opened and closed by control means. When either valve 21*a* or 21*b* is closed, a low pressure region is created in the space between the primary high velocity fluid jet stream and the closed valve causing the primary high velocity fluid jet stream to deflect. By alternating the opening and closing of suction port valves 21*a* and 21*b*, the primary high velocity fluid jet stream can be directed into each flow passage created by partition 15.

Figure 3:
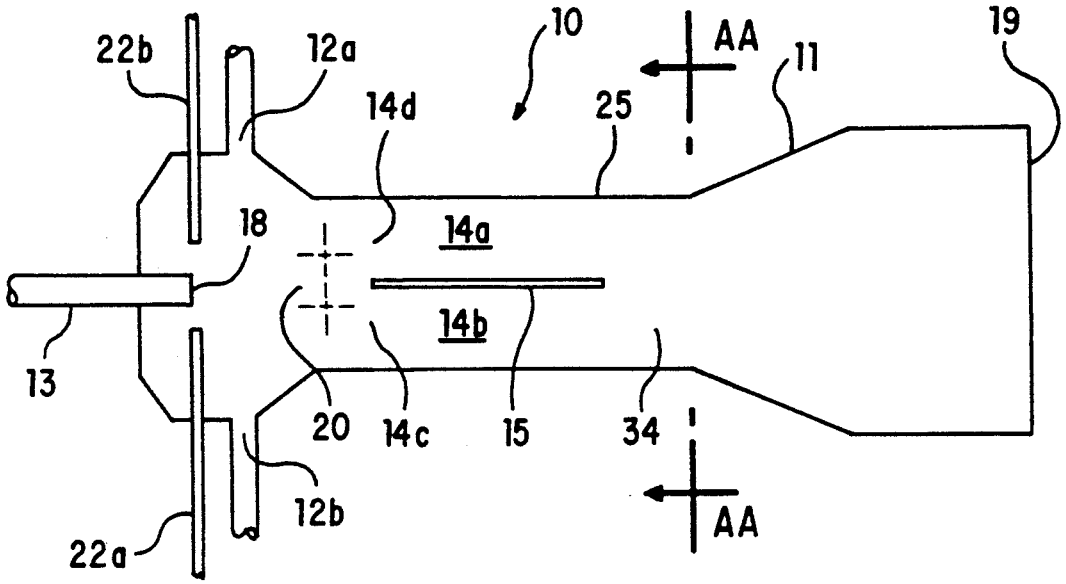
FIG. 3 is a schematic diagram showing a side view of a pulsating ejector according to still another embodiment of the invention.

In accordance with ye another embodiment of this invention as shown in FIG. 3, a primary high velocity fluid jet stream is injected through discharge end 18 of primary fluid nozzle 13 into inlet end 20 of mixer 25 containing partition 15 and parallel flow passages 14*a*, 14*b* and generally entrains secondary low velocity fluid through openings 12*a* and 12*b*. Disposed in a circumferential array around discharge end 18 of primary fluid nozzle 13 are auxiliary primary fluid nozzles 22*a* and 22*b* for injection of a portion of the total amount of primary high velocity fluid into mixer 25. Each auxiliary primary fluid nozzle 22*a*, 22*b* is positioned such that the primary high velocity fluid stream from auxiliary primary fluid nozzle 22*a*, 22*b* intersects the primary high velocity fluid jet stream from discharge end 18 at an incident angle defined by primary fluid nozzle 13 and auxiliary primary fluid nozzles 22*a* and 22*b* between about 1° and 100° with sufficient force to deflect the primary high velocity fluid jet stream. By alternately interrupting the flow of primary high velocity fluid through each auxiliary primary fluid nozzle 22*a* and 22*b*, the primary high velocity fluid jet stream injected through discharge end 18 of primary fluid nozzle 13 can be alternately directed into parallel flow passages 14*a* and 14*b*.

Figure 4:
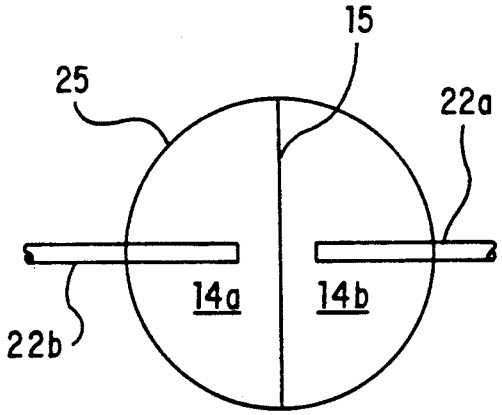
FIG. 4 is a schematic cross-sectional view taken along line AA—AA in FIG. 3.
Figure 5:
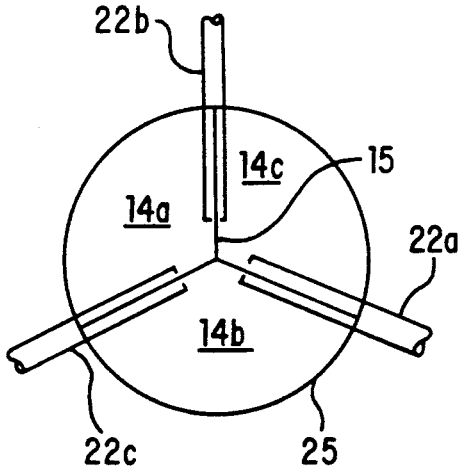
FIG. 5 is a similar schematic cross-sectional view as in FIG. 4 but showing another embodiment of the invention.

Mixer 25 may be partitioned into more than two parallel flow passages as shown in FIG. 5 and, in such embodiments of the invention, the number of auxiliary primary fluid nozzle locations positioned around discharge end 18 of primary nozzle 13 is preferably equal to the number of flow passages created by partition 15 in mixer 25. It will be apparent that each location may comprise more than one auxiliary primary fluid nozzle 22a, 22b. Thus, if a single partition 15 separates mixer 25 into two parallel flow passages 14a and 14b, then two auxiliary primary fluid nozzles 22a and 22b will be positioned at locations preferably opposing one another around discharge end 18 as shown in FIG. 4. In addition, auxiliary primary fluid nozzles 22a and 22b are preferably positioned such that the direction of the primary high velocity fluid stream from auxiliary primary fluid nozzles 22a and 22b defines a plane which is perpendicular to the plane of partition 15. Positioned in this manner as shown in FIG. 4, the auxiliary primary fluid stream from auxiliary primary fluid nozzle 22a diverts the primary high velocity fluid jet stream from discharge end 18 of primary fluid nozzle 13 into parallel flow passage 14a on the side of mixer 25 opposite auxiliary primary fluid nozzle 22a and auxiliary primary fluid nozzle 22b diverts the primary high velocity fluid jet stream from discharge end 18 of primary fluid nozzle 13 into parallel flow passage 14b on the side of mixer 25 opposite auxiliary primary fluid nozzle 22b.

In embodiments where mixer 25 is partitioned into three parallel flow passages 14a, 14b, and 14c by partition 15 as shown in FIG. 5, three auxiliary primary fluid nozzles 22a, 22b, and 22c are positioned around discharge end 18 of primary fluid nozzle 13. Auxiliary primary fluid nozzles 22a, 22b, and 22c preferably are each positioned on a side of mixer 25 opposite parallel flow passage 14a, 14b, or 14c into which the primary high velocity fluid jet stream from discharge end 18 of primary fluid nozzle 13 is diverted by the primary fluid stream from the respective auxiliary primary fluid nozzle. Thus, in a preferred embodiment of the invention where partition 15 defines three parallel flow passages 14a, 14b, and 14c, three auxiliary primary fluid nozzles 22a, 22b, and 22c are positioned around discharge end 18 of primary fluid nozzle 13, aligned opposite the parallel flow passage 14a, 14b, 14c, into which the primary high velocity fluid stream from each nozzle is designated to divert the primary high velocity fluid jet stream from discharge end 18 of primary fluid nozzle 13.

In still another embodiment of the invention, switching of the primary high velocity fluid jet stream from discharge end 18 of primary fluid nozzle 13 between parallel flow passages 14a and 14b is accomplished by creating an instability in the jet stream. In this embodiment, the lengths of parallel flow passages 14a and 14b and the volume of mixer 25 and diffuser 11 are adjusted to create a resonant system in which the primary high velocity fluid jet stream oscillates at a frequency determined by the dimensions of parallel flow passages 14a and 14b, mixer 25 and diffuser 11. Such a system establishes a standing wave frequency within each parallel flow passage and creates a back pressure which automatically switches the primary high velocity fluid jet stream between parallel flow passages 14a and 14b.

More specifically, the instability, known in the art as an "edge tone" instability, is inherent in an air jet blown against the leading edge of partition 15 and results in oscillation of the primary high velocity fluid jet stream between parallel flow passages 14a and 14b, which oscillation locks onto the resonant oscillations of parallel flow passages 14a, 14b. From known principles, the resonant frequency of the primary high velocity fluid jet stream is determined on the basis of the known relationship between sound speed and the length of parallel flow passages 14a, 14b; namely, the sound speed divided by four times the length of parallel flow passage 14a, 14b determines the resonant frequency of the jet stream. A quarter wave-length standing wave then exists in parallel flow passage 14a, 14b. Thus it follows that to achieve resonant oscillations in the oscillating jet ejector of this invention, the length of the mixing section, that is, mixer 25, must be equal to one quarter of the pressure wave speed divided by the frequency of oscillation. The parallel flow passages 14a and 14b will be 180° out of phase in the push-pull fashion due to the inherent "edge tone" instability of the primary high velocity fluid jet stream impinging on the leading edge of partition 15. Due to supersonic flow conditions, the pressure wave velocity will depend on the local instantaneous gas pressures and temperatures, the effects of which can be best evaluated by known methods employing wave diagrams such as are used for the calculation of flow phenomena in, for example, shock tubes. To avoid interference from high order resonant modes and produce approximately one-dimensional flow conditions, it is known that the length of mixer 25 should be a low multiple of the transverse dimension.

Figure 6:
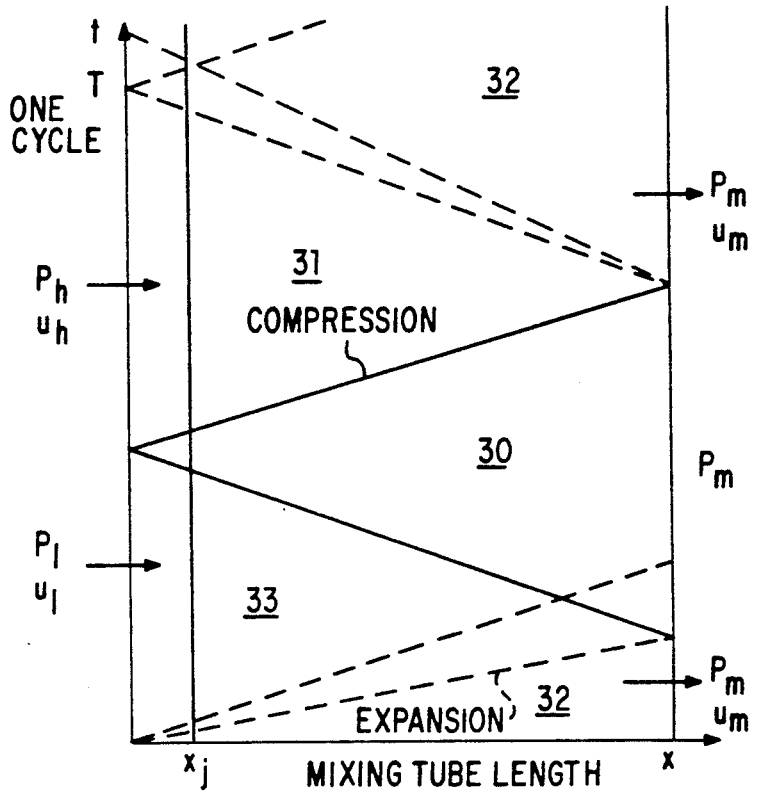
FIG. 6 is a wave diagram showing instantaneous state conditions of fluid in the parallel flow passages of an ejector in accordance with one embodiment of this invention.

Instantaneous state conditions of the fluid in each of parallel flow passages 14a, 14b of pulsating ejector 10 can be represented on a wave diagram as shown in FIG. 6. The pressure p and velocity u of the fluid is shown at a certain location x and a certain time t. This diagram is constructed using known principles as, for example, described in Shapiro, A.H., *The Dynamics and Thermodynamics of Compressible Fluid Flow*, Vol. II, The Ronald Press Company, 1954. Similar diagrams as applied to a "Comprex" rotary wave compressor are shown in a paper by Kentfield, J.A.C. "An Approximate Method for Predicting the Performance of Pressure Exchangers," ASME Paper 68 - WA/FE - 37.

Figure 7:
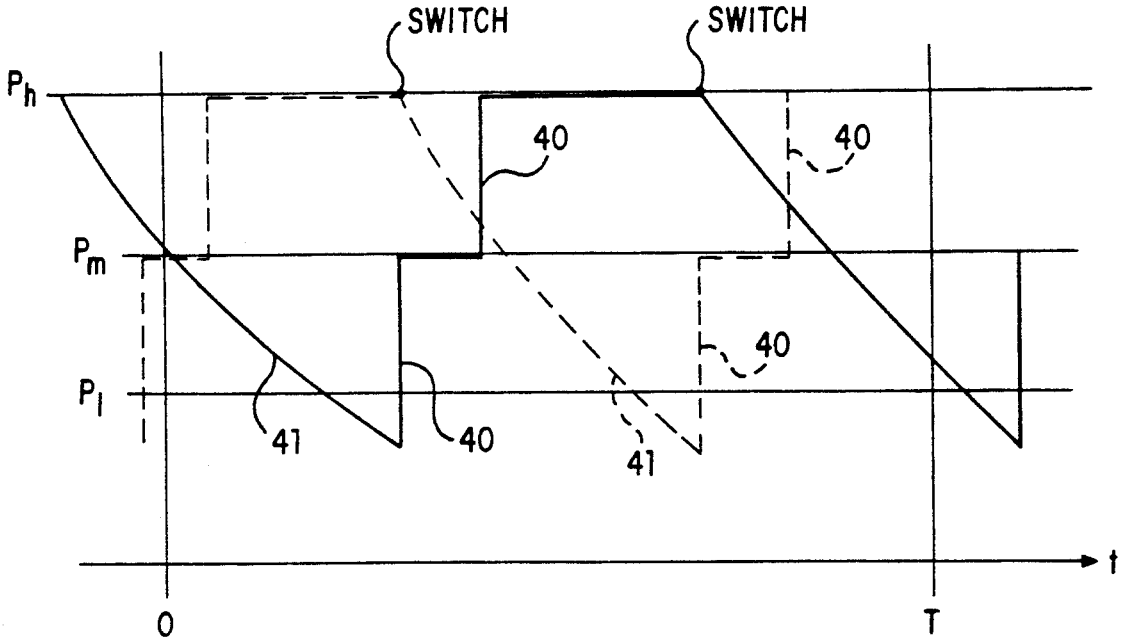
FIG. 7 is a diagram showing pressure oscillations in two parallel flow passages of an ejector in accordance with one embodiment of this invention.

The state of the fluid is approximately constant in each of the regions 30, 31, 32, and 33 of FIG. 6 and changes across the lines representing compression or rarefaction waves. A diagram, as shown in FIG. 7, of the variation of pressure with time at a given location $x_j$ can be constructed by reading off the pressure along a vertical line drawn through $x_j$ in FIG. 6. Compression waves represent a steep rise of pressure 40 while rarefaction waves represent a gradual decline of pressure 41.

The pressure oscillations in parallel flow passages 14a, 14b are 180 degrees out of phase as shown in FIG. 7 by solid and dashed lines respectively. The primary high velocity fluid jet stream is switched from one of parallel flow passages 14a, 14b to the other of parallel flow passages 14a, 14b when the pressure differential between parallel flow passages 14a, 14b at discharge end 18 of primary fluid nozzle 13 is at a maximum as indicated by the points indicated as switch points in FIG. 7. The jet is thus diverted from parallel flow passage 14a, 14b in which the pressure is high to parallel flow passage 14a, 14b in which the pressure is low.

Proximate inlet end 20 of mixer 25, the pressure oscillations $p_l$, $p_h$ are the highest. Proximate exit end 34 of mixer 25, the pressure, $p_m$, is almost constant. On the other hand, the velocities at inlet end 20 of mixer 25 are approximately the same, alternately from the high pressure jet, $u_h$, and from the low pressure supply, $u_l$. Proximate exit end 34 of mixer 25, the velocity oscillates between nearly no flow or some back flow in region 30 and maximum flow, $u_m$, in region 33.

At exit end 34 of parallel flow passages 14a, 14b, flow will be present alternately from one or the other of parallel flow passages 14a, 14b. At every instance immediately downstream thereof, the cross-sectional area available for the flow will be twice the cross-sectional area of either parallel flow passage 14a, 14b. Therefore, a sudden expansion of the flow will take place and the flow velocity will drop by half. One half of the velocity head, $\kappa(\rho u_m^2/2\ g)$ will be converted to pressure; one quarter will be lost and one quarter will remain as velocity head. In diffuser 11, the remaining velocity head can be transformed into pressure. Thus, the final exit pressure will be approximately $p_{eo}p_m+\frac{3}{4}\cdot\rho\cdot u_m^2/2\ g$.

The length of the passage downstream of parallel flow passages 14a, 14b and upstream of diffuser 11 should be 2 to 4 times the width of mixer 25. Diffuser 11 has an included angle of about 6 degrees and should achieve a cross-sectional area increase of 2:1. At diffuser exit 19, nearly constant pressure, $p_{eo}$, will prevail.

Figure 8:
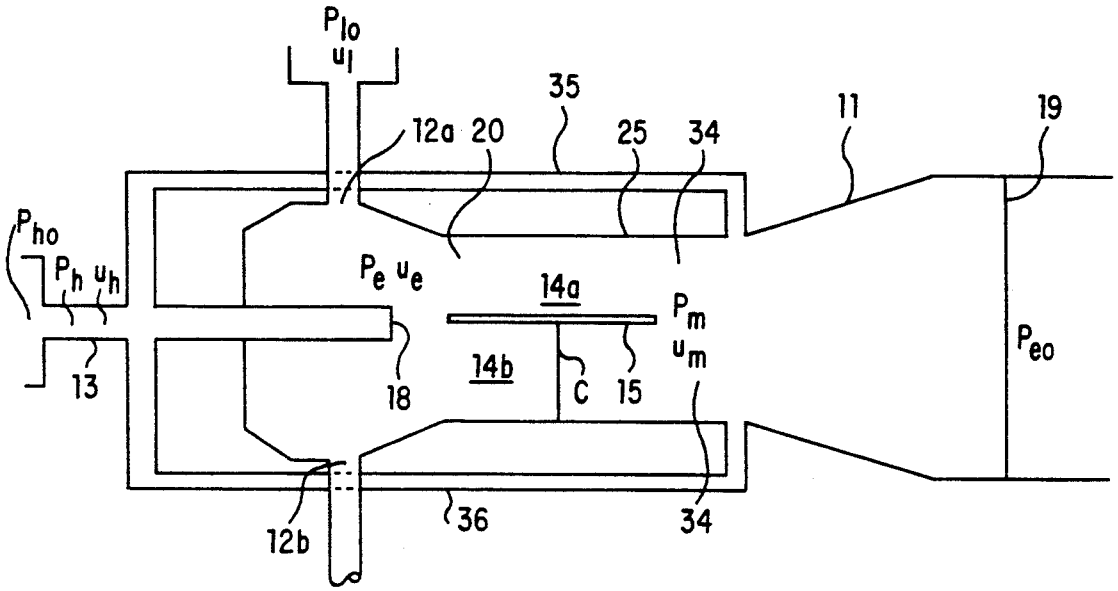
FIG. 8 is a schematic diagram showing a side view of an ejector in accordance with yet another embodiment of this invention.

Designing for a refrigeration application, the total pressure, $p_{lo}$, and mass flow, $m_l$, of the secondary flow velocity, low energy, fluid stream, and the final pressure at diffuser exit 19, $p_{eo}$, will be specified. From the wave diagram, the pressure and velocity of the low energy stream, $p_l$, $u_l$, can be calculated since $p_{lo}=p_l+\rho u_l^2/2\ g$. Here, $\rho$ is the local density of the fluid which is a function of the pressure as is well known. From these and the mass flow $m_l=\rho C u_l$, the mixing tube cross-sectional area C, as shown in FIG. 8, can be calculated. A width to depth ratio of mixer 25 of $\frac{1}{2}$ to $\frac{1}{3}$ is preferred for best efficiency. The length of mixer 25 should be a multiple of the width of parallel flow passage 14a, 14b (10 to 20 times) to assure a one-dimensional flow and to avoid higher resonant modes which would disperse the energy.

The tip of the partition 15 disposed proximate inlet end 20 of mixer 25 will be located at a distance of 5 to 10 times the nozzle width downstream from primary fluid nozzle 13.

The wave diagram will determine the time of one full cycle T, the inverse of the frequency.

It is preferred that openings 12a, 12b for introduction of the secondary low velocity, low energy, fluid stream be tuned to the same frequency to reinforce resonance. This can be done by making the inlet passage length of openings 12a, 12b a multiple of the wavelength or by using a "Helmholtz" resonator consisting of a volume and orifice attached to the passage.

The primary high velocity fluid jet stream will supply the power for compressing the secondary low velocity, low pressure stream from $p_{lo}$ to $p_{eo}$ and to compensate for losses. The energy required will be:

$$m_h[(p_{ho}/p_{eo})^{(k-1)/k}-1]=m_l[1-(p_{lo}/p_{eo})^{(k-1)/k}]/\eta$$

where $\eta$ is the power conversion efficiency of the ejector, which is estimated to be in the range from about 30% to about 50%. If it is assumed that the velocities of the primary high velocity fluid jet stream and the secondary low velocity stream are approximately equal, then the required pressure $p_{ho}$ of the primary high velocity fluid jet stream can be calculated.

In accordance with one embodiment of this invention, primary fluid nozzle 13 is a converging-diverging configuration as shown in FIG. 1 to produce supersonic velocities and can be designed according to established principles as described in the book of Shapiro, A.H., *The Dynamics and Thermodynamics of Compressible Fluid Flow*, Vol. I, pp. 78–88, The Ronald Press Company, New York, 1954. From the upstream pressure, $p_{ho}$, of the primary high velocity fluid jet stream and from the nozzle exit pressure known from the wave diagram, $p_h$, the pressure ratio across the converging-diverging supersonic nozzle can be calculated. This pressure ratio determines the nozzle exit Mach number $M_h$. Formulae or charts published in textbooks, such as the above, relate all physical quantities upstream and downstream of the nozzle with the Mach number $M_h$ including the geometrical proportions of the converging-diverging nozzle. The numerical value of the throat area of the primary fluid nozzle 13, where sonic velocity is reached, must be calculated from the mass flow rate of the primary high velocity fluid jet stream, $m_h$, using a well known relationship which also depends on the gas properties and the upstream conditions.

For very high compression ratios (well above 2:1), it is preferable to stage two or more ejectors in succession rather than to achieve the high pressure ratio in on stage. In this case, the exit flow of the first or preceding stage becomes the low pressure stream of the next stage. This is a well known practice in steady flow ejector technology.

At very high compression ratios, high flow rates, and correspondingly high velocities, the flow at exit end 34 of mixer 25 can become supersonic. As is well known, this precludes the propagation of pressure waves upstream which could trigger the switching of the primary jet. Therefore, at these conditions, secondary control passages 35, 36, are required parallel to parallel flow passages 14a, 14b, in which no net flow occurs but which can communicate the arrival of the pressure wave near exit end 34 of mixer 25 back to primary fluid nozzle 13 to bring about the switching as shown in FIG. 8.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. A process for mixing and compressing a primary fluid and a secondary fluid comprising:

injecting said primary fluid through a primary fluid nozzle having a discharge end into an inlet end of a mixer;

entraining said secondary fluid through an inlet end wall of said mixer having a plurality of openings;

inserting longitudinally a partition in said mixer forming a plurality of flow passages; and generating a resonance in said primary fluid alternatingly within each said flow passage.

2. In a pulsating ejector for use in a refrigeration system having a mixer with an inlet end and an exit end, a primary fluid nozzle through which a primary fluid is injected into said inlet end of said mixer aligned along a longitudinal mixer axis and having a discharge end facing said inlet end of said mixer, and an inlet end wall having a plurality of secondary fluid openings through which a secondary fluid is entrained, the improvement comprising:

a partition disposed longitudinally within said mixer forming a plurality of flow passages; and resonance means for generating a resonance in said primary fluid alternatingly in each of said flow passages.

3. In a pulsating ejector according to claim 2, wherein a diffuser is connected to said exit end of said mixer, the distance between a flow passage exit of said flow passage and said diffuser being between about 2 to 4 times the width of said mixer.

4. In a pulsating ejector according to claim 3, wherein said diffuser has an included angle to achieve an increase in cross-sectional area over a mixer cross-sectional area of about 2:1.

5. In a pulsating ejector according to claim 2, wherein said resonance means comprises said mixer having a mixer length about 10 to 20 times said width of said flow passages.

6. In a pulsating ejector according to claim 5, wherein said resonance means further comprises the end of said partition proximate said inlet end of said mixer being at a distance of about 2 to 3 times the width of said flow passage downstream of said primary fluid nozzle.

7. In a pulsating ejector according to claim 2, wherein a secondary control passage is disposed parallel to said flow passages, said secondary control passage in communication with said mixer and said primary fluid nozzle.

8. A pulsating ejector for use in a refrigeration system comprising:

a mixer having an inlet end and an exit end;

means for injecting a primary fluid into said inlet end;

means for entraining a secondary fluid into said inlet end;

a partition disposed longitudinally within said mixer forming a plurality of flow passages;

a diffuser connected to said exit end of said mixer and in communication with said mixer; and resonance means for generating a resonance in said primary fluid alternatingly in each of said flow passages.

9. A pulsating ejector according to claim 8, wherein said means for injecting a primary fluid comprises a primary fluid nozzle having a discharge end and injection means for injecting said primary fluid along a longitudinal mixer axis of said mixer.

10. A pulsating ejector according to claim 8, wherein the distance between a flow passage exit of said flow passage and said diffuser is between about 2 to 4 times the width of said mixer.

11. A pulsating ejector according to claim 8, wherein said diffuser has an included angle to achieve an increase in cross-sectional area over a mixer cross-sectional area of about 2:1.

12. A pulsating ejector according to claim 8, wherein a secondary control passage is disposed parallel to said flow passages, said secondary control passage in communication with said exit end of said mixer and said means for ejecting said primary fluid.

13. A pulsating ejector in accordance with claim 8, wherein said resonance means comprises each said flow passage having a cross-sectional area determined in accordance with the formula:

$$m_l = \rho C u_l,$$

where $m_l$ is the mass flow of the secondary fluid, $\rho$ is the local density of the secondary fluid, and $u_l$ is the velocity of the secondary fluid.

14. A pulsating ejector according to claim 12, wherein said resonance means further comprises said mixer having a mixer length about 10 to 20 times said width of said flow passages.

15. A pulsating ejector according to claim 14, wherein said resonance means further comprises the end of said partition proximate said inlet end of said mixer being at a distance of about 2 to 3 times the width of said flow passage downstream of said primary fluid nozzle.

16. A pulsating ejector for use in a refrigeration system comprising:

a mixer having an inlet end and an exit end;

means for injecting a primary fluid into said inlet end;

means for entraining a secondary fluid into said inlet end;

a partition disposed longitudinally within said mixer forming a plurality of flow passages, each flow passage having a cross-sectional area determined in accordance with the formula:

$$m_l = \rho C u_l,$$

where $m_l$ is the mass flow of the secondary fluid, $\rho$ is the local density of the secondary fluid, and $u_l$ is the velocity of the secondary fluid;

said mixer having a mixer length about 10 to 20 times said width of said flow passage; and the end of said partition proximate said inlet end of said mixer being at a distance of about 2 to 10 times the width of said flow passage downstream of said means for injecting said primary fluid.

17. A pulsating ejector in accordance with claim 16, wherein the distance between a flow passage exit of said flow passage and said diffuser is between about 2 to 4 times the width of said mixer.

18. A pulsating ejector in accordance with claim 16, wherein said diffuser has an included angle to achieve an increase in cross-sectional area over a mixer cross-sectional area of about 2:1.

19. A pulsating ejector in accordance with claim 16, wherein a secondary control passage is disposed parallel to said flow passages, said secondary control passage being in communication with said exit end of said mixer and said means for ejecting said primary fluid.

* * * * *